US010280639B2

(12) United States Patent
Meredith

(10) Patent No.: US 10,280,639 B2
(45) Date of Patent: May 7, 2019

(54) MATERIALS AND METHODS FOR LINING A CHIMNEY

(71) Applicant: John E. Meredith, Richmond, IN (US)

(72) Inventor: John E. Meredith, Richmond, IN (US)

( * ) Notice: Subject to any disclaimer, the term of this patent is extended or adjusted under 35 U.S.C. 154(b) by 1621 days.

(21) Appl. No.: 13/804,499

(22) Filed: Mar. 14, 2013

(65) Prior Publication Data

US 2013/0192160 A1 Aug. 1, 2013

Related U.S. Application Data

(63) Continuation-in-part of application No. 13/235,777, filed on Sep. 19, 2011, now abandoned, which is a continuation of application No. 12/029,525, filed on Feb. 12, 2008, now abandoned.

(60) Provisional application No. 60/889,331, filed on Feb. 12, 2007.

(51) Int. Cl.

| | |
|---|---|
| ***E04G 23/02*** | (2006.01) |
| ***F23J 13/02*** | (2006.01) |
| ***E04G 23/00*** | (2006.01) |

(52) U.S. Cl.

CPC ..... *E04G 23/02* (2013.01); *E04G 23/008* (2013.01); *F23J 13/02* (2013.01); *F23J 2213/101* (2013.01); *F23J 2213/40* (2013.01); *F23J 2900/13022* (2013.01)

(58) Field of Classification Search

CPC ..... E02D 29/12; E04G 23/02; E04G 23/008; F23J 13/02

USPC ..... 454/44, 45; 52/741.1

See application file for complete search history.

(56) References Cited

U.S. PATENT DOCUMENTS

| | | | | |
|---|---|---|---|---|
| 1,147,374 A * | 7/1915 | Coe | A46B 11/0013 401/137 |
| 1,469,712 A | 10/1923 | Beeby | |
| 3,281,308 A | 10/1966 | D'Asto | |
| 3,352,072 A | 11/1967 | Bole | |
| 3,367,075 A * | 2/1968 | Pierce et al. | 52/249 |

(Continued)

FOREIGN PATENT DOCUMENTS

| | | | |
|---|---|---|---|
| DE | 1 255 019 | 11/1971 | |
| EP | 0426539 A1 * | 5/1991 | E04F 17/02 |

(Continued)

OTHER PUBLICATIONS

Estoup, et al, EP 0426539 A1 English machine translation, May 8, 1991.*

*Primary Examiner* — Kenneth Rinehart
*Assistant Examiner* — Phillip Decker
(74) *Attorney, Agent, or Firm* — Woodard, Emhardt, Henry, Reeves & Wagner, LLP

(57) ABSTRACT

A method of relining a chimney includes: coating the inside surface of a chimney flue with a first layer of a flowable refractory material to provide a wet and sticky surface on the inside of the chimney flue; providing an insulating sleeve on the refractory surface so that the insulating sleeve adheres to the refractory surface; coating the inner surface of the sleeve with a second layer of flowable refractory material effective for hardening to provide a refractory surface on the inner surface of the sleeve; and allowing both layers of flowable refractory material to harden, thus providing a hardened relining comprising a first refractory layer, an insulating layer, and a second refractory layer on the inner surface of the sleeve.

5 Claims, 12 Drawing Sheets

(56) References Cited

U.S. PATENT DOCUMENTS

| | | | | |
|---|---|---|---|---|
| 3,379,544 | A * | 4/1968 | Burhans | C04B 28/342 501/106 |
| 3,649,313 | A * | 3/1972 | Fisher | C04B 28/34 106/691 |
| 3,932,249 | A | 1/1976 | Jury et al. | |
| 4,085,001 | A | 4/1978 | Fukuwatari et al. | |
| 4,143,104 | A | 3/1979 | Van Konijnenburg et al. | |
| 4,240,995 | A | 12/1980 | Milne | |
| 4,306,491 | A | 12/1981 | Reardon | |
| 4,324,602 | A * | 4/1982 | Davis | C04B 35/632 156/155 |
| 4,380,228 | A | 4/1983 | Crowley | |
| 4,386,628 | A | 6/1983 | Stanley | |
| 4,442,050 | A | 4/1984 | Takuo | |
| 4,573,400 | A | 3/1986 | Foy | |
| 4,964,369 | A | 10/1990 | Sporn | |
| 5,002,438 | A | 3/1991 | Strong | |
| 5,106,440 | A | 4/1992 | Tangeman | |
| 5,385,752 | A | 1/1995 | Steele | |
| 5,632,937 | A | 5/1997 | Soofi et al. | |
| 5,966,866 | A | 10/1999 | Di Loreto | |
| 6,024,085 | A * | 2/2000 | Hodge | F24B 1/18 110/336 |
| 6,199,345 | B1 | 3/2001 | Dean | |
| 6,878,323 | B2 | 4/2005 | Fyfe | |
| 6,881,257 | B2 | 4/2005 | Beauboeuf | |
| 6,892,505 | B1 | 5/2005 | Pingitore | |
| 6,897,169 | B2 * | 5/2005 | Matsui | C04B 41/009 427/446 |
| 6,959,903 | B1 | 11/2005 | West et al. | |
| 7,104,789 | B1 * | 9/2006 | Robich | F27B 13/10 432/194 |
| 7,302,779 | B2 | 12/2007 | Endre | |
| 2001/0049919 | A1 | 12/2001 | Fyfe | |
| 2003/0207103 | A1 * | 11/2003 | Zvosec | B32B 1/08 428/329 |
| 2004/0025465 | A1 | 2/2004 | Aldea et al. | |
| 2005/0139308 | A1 | 6/2005 | Aldea et al. | |
| 2007/0113519 | A1 * | 5/2007 | Kiest, Jr. | E02D 29/12 52/741.3 |

FOREIGN PATENT DOCUMENTS

| | | | |
|---|---|---|---|
| EP | 599305 | A1 * | 6/1994 |
| GB | 1255019 | A * | 11/1971 |

* cited by examiner

MATERIALS AND METHODS FOR LINING A CHIMNEY

REFERENCE TO RELATED APPLICATIONS

This application is a continuation-in-part of U.S. patent application Ser. No. 13/235,777, pending, filed Sep. 19, 2011, which is a continuation of U.S. patent application Ser. No. 12/029,525, now abandoned, filed Feb. 12, 2008, which claims the benefit of U.S. Provisional Patent Application Ser. No. 60/889,331, filed Feb. 12, 2007. The entire contents of all referenced applications are hereby incorporated by reference.

FIELD OF THE INVENTION

The present invention relates generally to materials and methods for lining a chimney, and more particularly to materials and methods for sizing/resizing and/or lining/relining a new or existing chimney using a flowable ceramic material.

BACKGROUND OF THE INVENTION

Masonry chimneys are commonly constructed with an inner liner of clay tiles designed to keep the heat of the flue gasses inside the chimney. This prevents the chimney from overheating and potentially igniting nearby combustible material, such as the framing and walls of the building to which the chimney is attached. The liner also keeps harmful flue gasses, moisture, smoke, creosote, and other combustion products from seeping through the chimney and leaking into the building. A secure lining system is therefore critical to ensure the safety of the chimney and the health of the occupants of the attached structure.

If a liner was not installed in a chimney system, or if the original liner cracks, crumbles or deteriorates over time, a new liner should be installed. One common way to reline a chimney has been with stainless steel relining pipe. With this method a round or oval stainless steel liner is installed in the chimney. The metal pipe can be either rigid or somewhat flexible, with flexible liners being used most commonly in chimneys with offsets. Alternatively, an aluminum or other metal liner may be used in place of stainless steel.

One problem associated with metal chimney liners such as stainless steel is that the liner is susceptible to attack by certain acids and chemicals that are the byproducts of combustion (flue gases). Also, metal chimney liners are prone to disfiguration when subjected to high temperatures such as may be faced during a chimney fire.

As an alternative to a metal lining system, a cast-in-place liner may be used. With a cast-in-place liner a round or oval bladder (or a series of bladders for larger openings) is installed in the chimney and a masonry material is subsequently poured around the inflated form. After the material has cured, the bladder is deflated and removed, leaving the new masonry material as a liner in the chimney.

While all of the above systems provide clear benefits, they all have disadvantages as well. For example, metal lining systems are generally not good insulators, making them less effective against heat transfer from the flue to the surrounding structure unless a heavy insulating blanket is used around the liner. Cast-in-place systems may be good insulators, but they tend to significantly reduce the size of the flue. In addition, cast-in-place systems are less effective when the existing chimney is weak or crumbling and cannot adequately support the freshly poured masonry material.

In view of the above it can be seen that a need exists for an improved system for relining a chimney. The present invention addresses that need.

SUMMARY OF THE INVENTION

A method of relining a chimney, comprising: coating the inside surface of a chimney flue with a first layer of a flowable refractory material, thus providing a wet and sticky surface on the inside of said chimney flue; providing an insulating sleeve on the wet and sticky refractory surface in a manner such that the insulating sleeve adheres to the wet and sticky refractory surface; subsequently coating the inner surface of said sleeve with a second layer of flowable refractory material effective for hardening on the sleeve to provide a refractory surface on the inner surface of the sleeve; and allowing both layers of flowable refractory material to harden, thus providing a hardened relining comprising a first refractory layer, an insulating layer, and a second refractory layer on the inner surface of the sleeve.

The insulating sleeve is preferably a multi-layer sleeve comprising:

a first, outer layer of a metal wire material, such as a high temperature blanket mesh or metal screen;

a middle insulating layer, which is preferably made of ⅜" ceramic fiber paper; and a second outer layer of a metal wire material, such as a high temperature blanket mesh or metal screen.

The flowable refractory material may be made of a blend of inorganic materials and inert aggregates together with a high temperature resin bonding agent. The inert aggregates may include 50-80% $Al_2O_3$ and 10-40% $SiO_2$.

DESCRIPTION OF THE PREFERRED EMBODIMENTS

Figure 1:
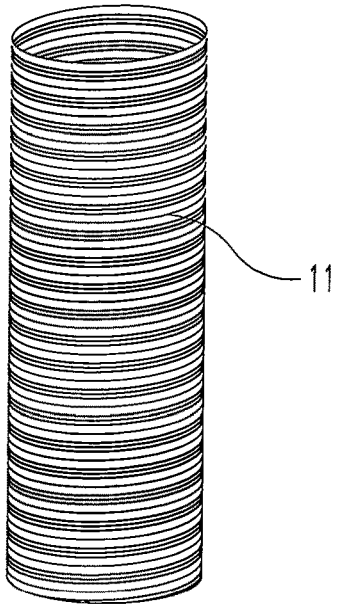
FIG. 1 shows a sleeve of the chimney lining system of the present invention, according to one preferred embodiment.
Figure 2:
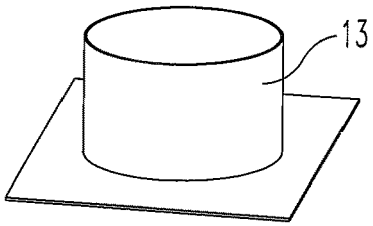
FIG. 2 shows attaching hardware to attach the sleeve of the chimney lining system to a chimney, according to one preferred embodiment.
Figure 3:
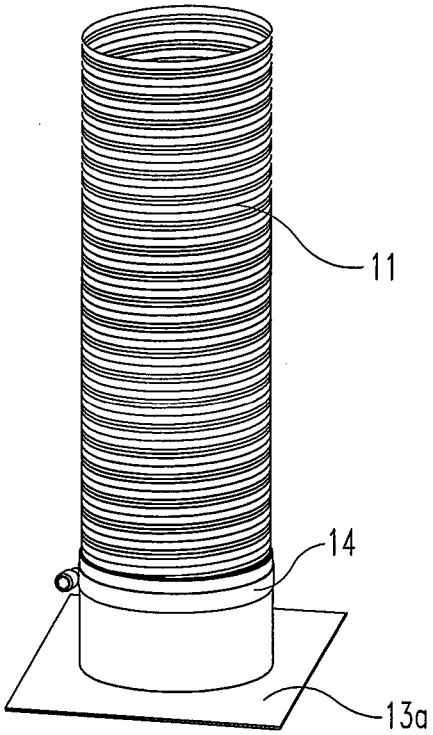
FIG. 3 shows a sleeve of the chimney lining system of the present invention with the bottom attaching hardware attached, according to one preferred embodiment.
Figure 4:
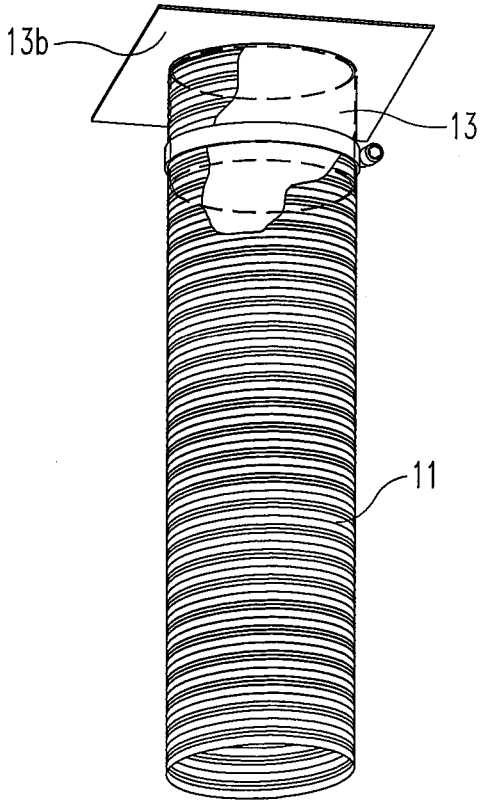
FIG. 4 shows a sleeve of the chimney lining system of the present invention with the top attaching hardware attached, according to one preferred embodiment.
Figure 5:
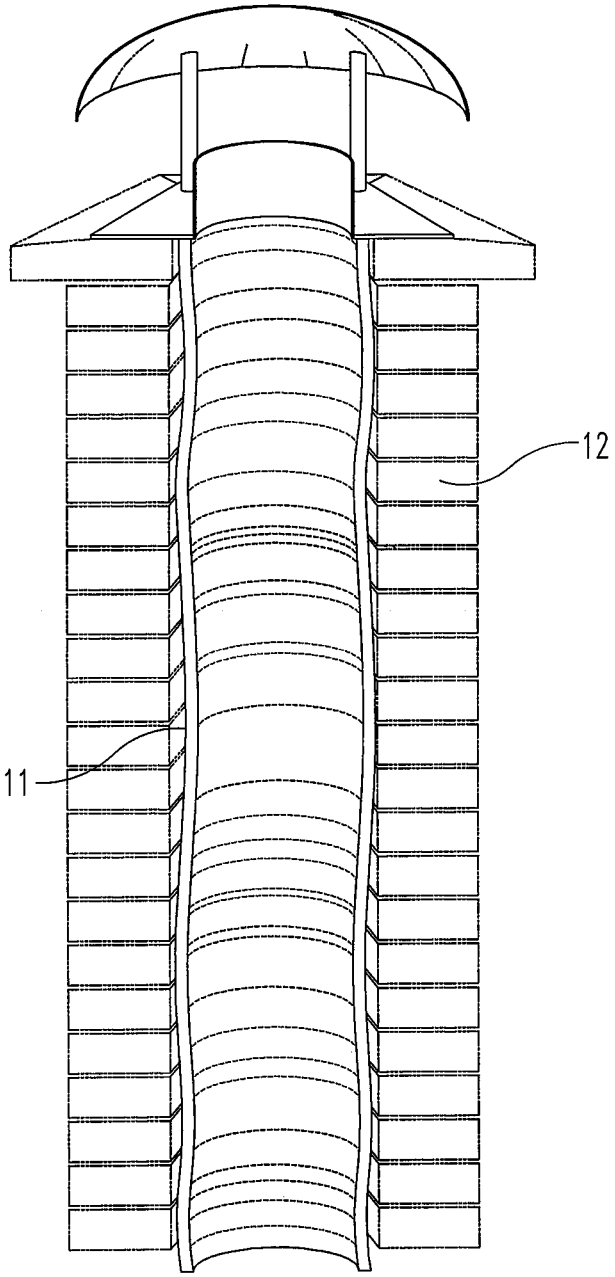
FIG. 5 shows the chimney lining system of the present invention, according to one preferred embodiment.

For the purposes of promoting an understanding of the principles of the invention, reference will now be made to certain embodiments and specific language will be used to describe the same. It will nevertheless be understood that no limitation of the scope of the invention is thereby intended. Instead, the claims of the application are intended to cover all alterations and further modifications in the illustrated invention, and such further applications of the principles of the invention disclosed herein, as would normally occur to one skilled in the art to which the invention relates.

As indicated above, one aspect of the present invention provides a method for relining a chimney that services a fireplace or heating appliance, such as a wood, coal or oil, gas burning appliance. While additional applications are intended to be within the scope of the present invention, the materials and methods of the present invention find particular utility with field-installation into new or existing masonry chimneys that are used for the natural draft venting of Category I gas-fired, Type L vented oil-fired, or solid-fuel-fired residential-type appliances in which the maximum continuous flue-gas outlet temperatures do not exceed 1000° F. (538° C.).

In one embodiment of the present invention a sleeve is inserted in the chimney, and is secured at one or both ends. The sleeve is then coated with a flowable refractory material effective for hardening on the sleeve to provide a refractory surface on the inner surface of the sleeve. The coating process occurs while the sleeve is positioned in the chimney. When the flowable refractory material dries or cures, the lined sleeve provides a barrier effective to keep flue gasses, moisture, etc. from seeping through the chimney and leaking into the building. The lined sleeve also insulates the chimney to prevent overheating of any combustibles that may be in close proximity to the outside of the chimney wall.

1. The Sleeve Material

In one aspect of the present invention a sleeve is inserted into the chimney and is subsequently coated with the flowable refractory material to provide a barrier to temperature, gas, water, etc. The sleeve may therefore be made of any material capable of performing the function of providing a supporting substrate for the flowable refractory material and withstanding the temperatures to which the lined sleeve may be exposed.

In one embodiment the sleeve may be made of a flexible material. For example, a flexible, synthetic or inorganic textile capable of withstanding the appropriate temperatures may be used.

In other embodiments the sleeve may be made of a rigid or semi-rigid material. For example, a tube of stainless steel, aluminum, or other alloys capable of withstanding the appropriate temperatures may be used. A rigid or semi-rigid tube may be solid, or it may be a mesh, wire or other non-solid construction.

The temperatures that the sleeve material must be capable of withstanding may depend on the expected use of the chimney. For example, if the intended use is with a coal or wood fired stove, the sleeve should be capable of withstanding temperatures of at least 1800° F., and preferably 2100° F. If the intended use is a gas or oil fired appliance, the sleeve may be constructed of a material that is capable of withstanding somewhat lower temperatures, such as 1000° F. In other embodiments the sleeve may be constructed of a material that is capable of withstanding intermediate temperatures, such as 1500° F.

The size of the sleeve may approximate the inner diameter of the chimney. When the chimney is attached to an open fireplace, it is desirable that the sleeve should be sized to provide a lined opening with area that is at least 1/10 (or under some circumstances 1/12) the size of the fireplace opening. In all cases the cross-sectional area of the lined sleeve should satisfy the draft requirements of the connected fireplace or appliance(s), as specified by the manufacturer's instructions or other approved methods.

In one preferred embodiment the sleeve comprises a ceramic wool or ceramic paper blanket with a metallic foil outer shell or backing. The metallic foil outer shell acts as a vapor barrier to protect the ceramic wool or ceramic paper from moisture.

For example, ceramic papers made of a blend of high purity ceramic fibers comprising about 47% $Al_2O_3$ and about 53% $SiO_2$, optionally with trace amounts of organic binders, and having a melting point of about 3200° F., a maximum temperature rating of 2300° F., and a continuous use limit of 2150° F. may advantageously be used. (Some such ceramic papers are sold under the trade name Kaowool® Flex-Wrap, and are described in Thermal Ceramics' Kaowool® Paper product information, incorporated herein by reference.)

The ceramic paper may be covered with a foil layer, which may be provided as a triple ply laminate having a fiberglass scrim adhered with a fire retardant, thermo-setting adhesive to an aluminized polyester face and an aluminum foil backing, such as the scrim base sold under the trade name "Alaflex" by Alpha Associates. (Described in Alpha Associates, Inc. Data Sheet 12535, incorporated herein by reference.) The foil layer preferably has a temperature resistance (per Fed. Spec. HHB-100B) of at least 300° F.

A stainless steel mesh may be provided over the sleeve material to reinforce and protect the sleeve during placement in a chimney.

2. The Flowable Refractory Material

The flowable refractory material is preferably a high temperature, castable or moldable refractory coating capable of withstanding temperatures of at least 2100° F., more preferably at least 2300° F., and most preferably at least 2500° F. In some embodiments the flowable refractory material utilizes a (wet or dry) water based inorganic binder system that is resistant to hot gases, flame, water and chemical erosion. The flowable refractory material may be provided as a one- or a two-component system.

Preferably, the flowable refractory material comprises a material that will air dry in no more than 48 hours (at ambient temperatures of 10-35° C.) to a hard, abrasion resistant, non-water soluble coating. In some embodiments the flowable refractory material may require increased air flow (fans, etc.) or increased temperatures (above 35° C.) to harden to an abrasion resistant coating. The flowable refractory material may comprise a material that can be fired at a low temperature (e.g., less than 300° C.) for 24 to 48 hours until it is completely cured.

The flowable refractory material must be capable of adhering to the substrate to which it is applied, preferably without sagging, slumping, or flowing off of the surface when wet. In some preferred embodiments the flowable refractory material also provides good insulating properties and/or good thermal shock resistance. The flowable refractory material should have good chemical stability and not react with flue gasses or chimney components under normal (or even extreme) operating conditions.

The flowable refractory material is preferably capable of being applied by brush, foam pad, a movable "bell" or "cone" (as described herein), sprayer or trowel. The material should be viscous enough to form a slurry that can be easily applied yet evenly coats the sleeve material. If the material is too thick or too thin, the material may be difficult to apply or may not provide an adequate coating.

The flowable refractory material may include a blend of inorganic minerals and binders, and may include ceramic fibers. The preferred material is Eldfast made by the Fa: J. Kikson Company, Vallentuna, Sweden. Eldfast is a ceramic material that does not contain cement or lime. It is composed of a blend of inorganic materials and inert aggregates together with a high temperature resin bonding agent in a powdered or liquid form. When these ingredients are mixed with water the result is a slurry that is flowable. It chemically sets and is water and acid resistant. The composition comprises 60-80% $Al_2O_3$ and 40-20% $SiO_2$.

3. The Method of Use

As previously indicated, in one embodiment of the present invention a sleeve is inserted in the chimney, and is secured at one or both ends. The sleeve is then coated with a flowable refractory material effective for hardening on the sleeve to provide a refractory surface on the inner surface of the sleeve. The coating process occurs while the sleeve is positioned in the chimney. After the flowable refractory material dries or cures, the lined sleeve provides a barrier effective to keep flue gasses, moisture, etc. from seeping through the chimney and leaking into the building.

Referring now to the drawings, and particularly to FIGS. 1-5, a high-temperature resistant sleeve 11 effective for providing a substrate for the flowable refractory material is provided. Sleeve 11 may comprise one or more layers, including a supporting layer 11*a* and a moisture barrier layer 11*b*. Foil tape 11*c* may be used to reinforce seams, and to provide additional support to the sleeve. A metallic mesh may cover the sleeve to protect it from tearing.

The sleeve is preferably sized to fit in the chimney 12 being relined or otherwise provided with the liner of the present invention. The diameter of the sleeve should be such that the lined sleeve will satisfy the draft requirements of the fireplace and/or appliance being served.

A relatively short (normally between 8 and 18 inches) section of heat and corrosion resistant stainless steel is preferably attached at the top of the sleeve to serve as a top end adapter 13. The first end 13*a* of top end adaptor 13 preferably matches the shape and size the sleeve to facilitate connection with the sleeve. (As noted above, the sleeve may be significantly smaller than the existing flue's total interior area or it could be constructed to closely match the existing flue's interior shape, which is typically, round, square, rectangle or oval.) A large hose clamp 14 may be used to hold the sleeve securely to the first end of the stainless steel adapter. A top plate 13*c* may be provided on top end adaptor 13 to facilitate installing the top end adaptor on a chimney. A rain cap 13*d* may also be provided on the second end 13*b* of top end adaptor 13.

A second section of heat and corrosion resistant stainless steel is preferably attached at the bottom of the sleeve to serve as a bottom end adapter. Here too, the first end 15*a* of a bottom end adaptor preferably matches the shape and size the sleeve to facilitate connection with the sleeve. The second end 15*b* of a bottom end adaptor may be any of a variety of shapes, according to whether the bottom end terminates in a fireplace or an appliance, etc.

In one embodiment a bottom end adaptor includes a bottom plate that facilitates termination of the sleeve at a fireplace opening. With this embodiment a hose clamp 14 may be used to secure sleeve 11 to a bottom end adaptor.

In another embodiment a bottom end adaptor is a T-shaped adaptor to facilitate connection to a heating appliance. The bottom adaptor may include a first end and a second end 15*e*' and a third end. Second end 15*e*' may be attached to a heating appliance (not shown), and the third end may be a clean-out trap to facilitate collection and cleaning of waste.

The sleeve is inserted into the chimney's interior. In the preferred method of installation a top plate is used. The top adapter 13*b* may be inserted into an opening in a stainless steel top plate with an opening slightly larger than the outside diameter of the top adapter. The outside dimensions of the top plate would be larger than the opening of the chimney as to not allow the assembly to drop down into the chimney's interior. The top adapter is then secured with a clamp on the top side of the top plate. A rain cap may be attached to the top attaching hardware.

The bottom adapter 13*a* is then attached to a stainless steel tee section of pipe, preferably using a hose clamp as illustrated. In one preferred method a tee with a removable snout is attached to the bottom adaptor, with the snout or take off then being attached according to the tee manufacturer's directions and secured through the chimney's bottom opening into the interior space.

Figure 6:
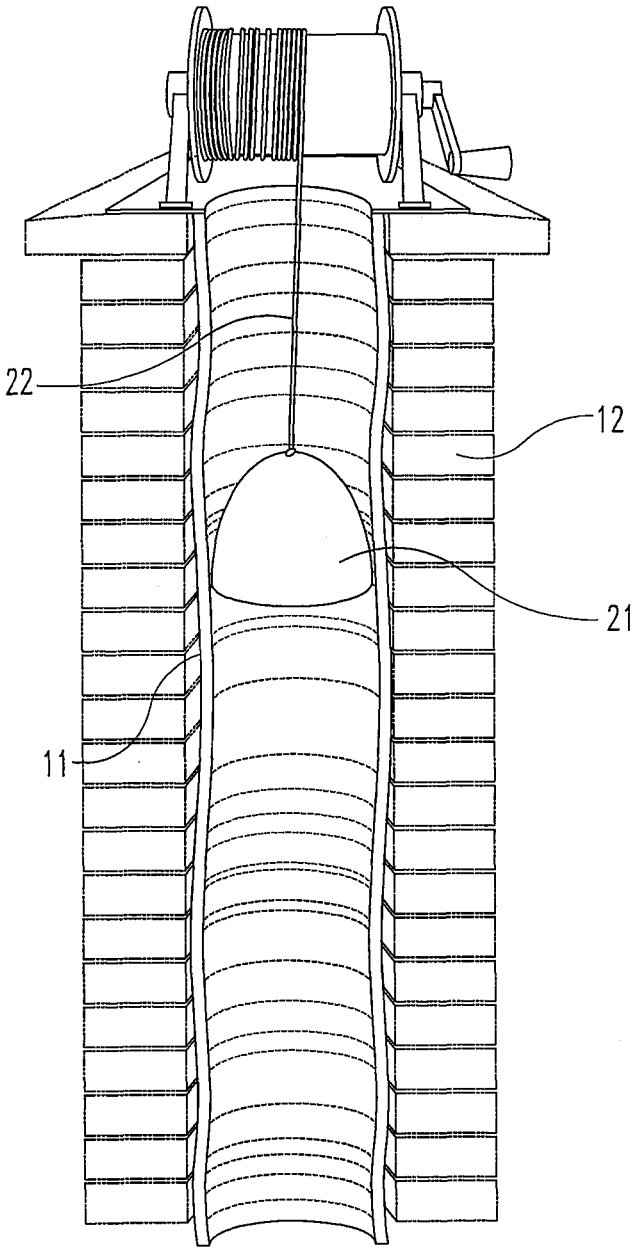
FIG. 6 shows a tool for lining a chimney using the chimney lining system of the present invention, according to one preferred embodiment.

Referring now to FIG. 6, a conical shaped applicator 21 may be inserted into the bottom tee opening and attached to a metallic cable 22 (or a non-metallic rope or strap, etc.) which is attached to a winch which is secured to the top of the chimney 12 and centered over the opening of the completed assembly or the applicator can be attached to cable and lowered to the bottom of the above assembly. A centering device may be attached to the applicator to hold the applicator centered in the sleeve so that the lining material is evenly applied around the circumference of the applicator. A vibrator may be incorporated into or attached to the applicator to facilitate application of the flowable ceramic material.

Figure 7:
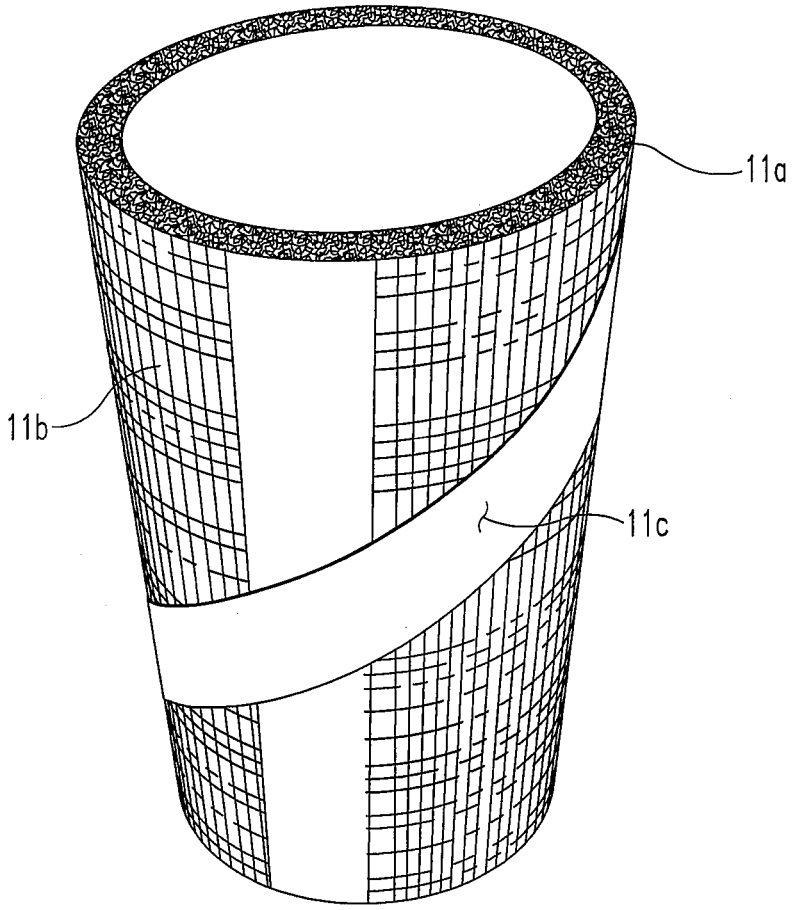
FIG. 7 shows a section of the chimney lining system of the present invention, according to one preferred embodiment.
Figure 8:
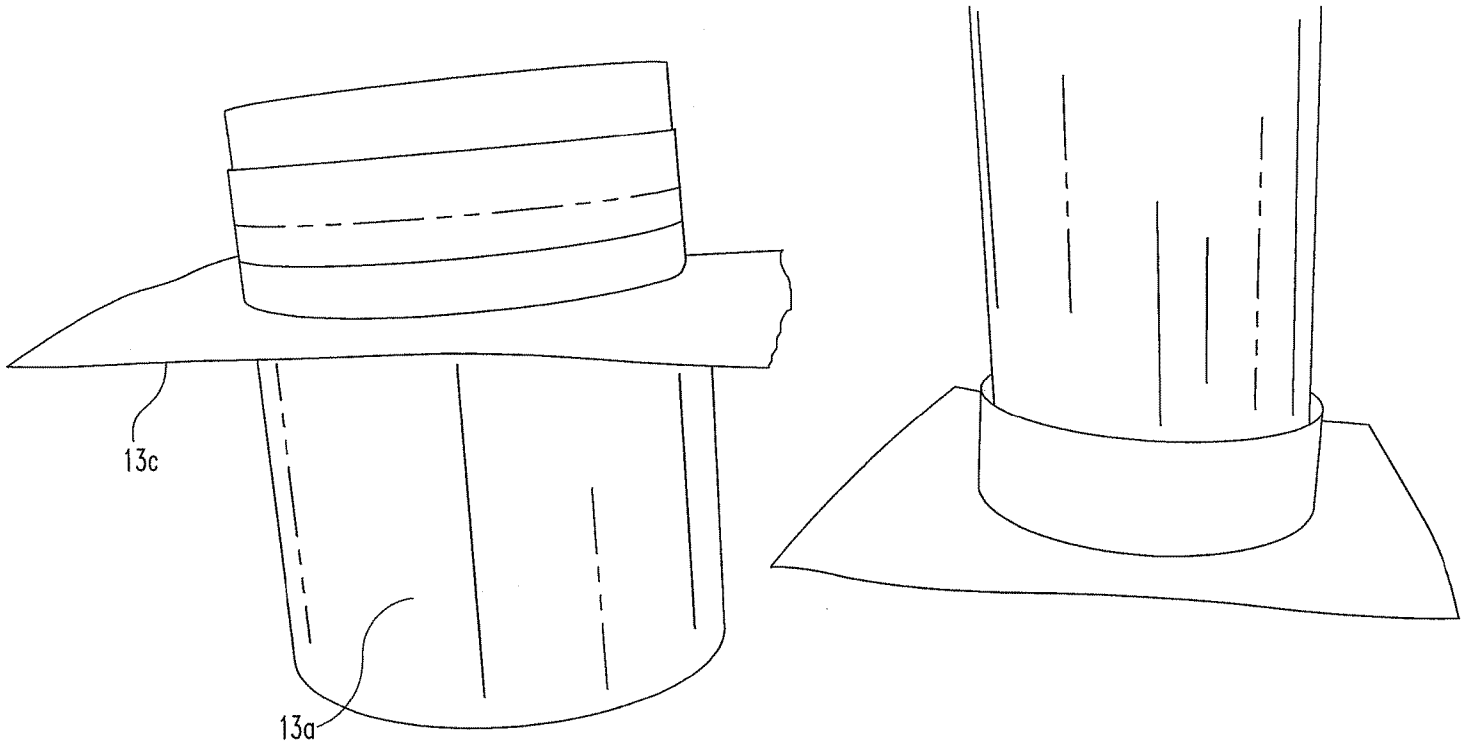
FIG. 8 shows one embodiment of a top end adaptor, according to one preferred embodiment of the present invention.
Figure 9:
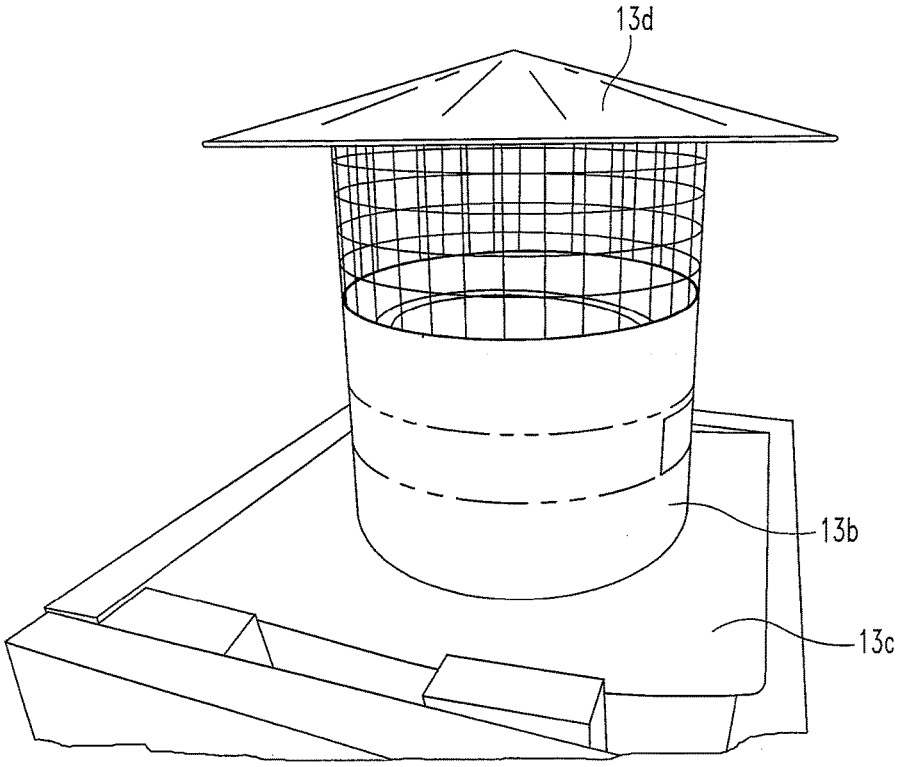
FIG. 9 shows one embodiment of a top end adaptor, according to one preferred embodiment of the present invention.
Figure 10:
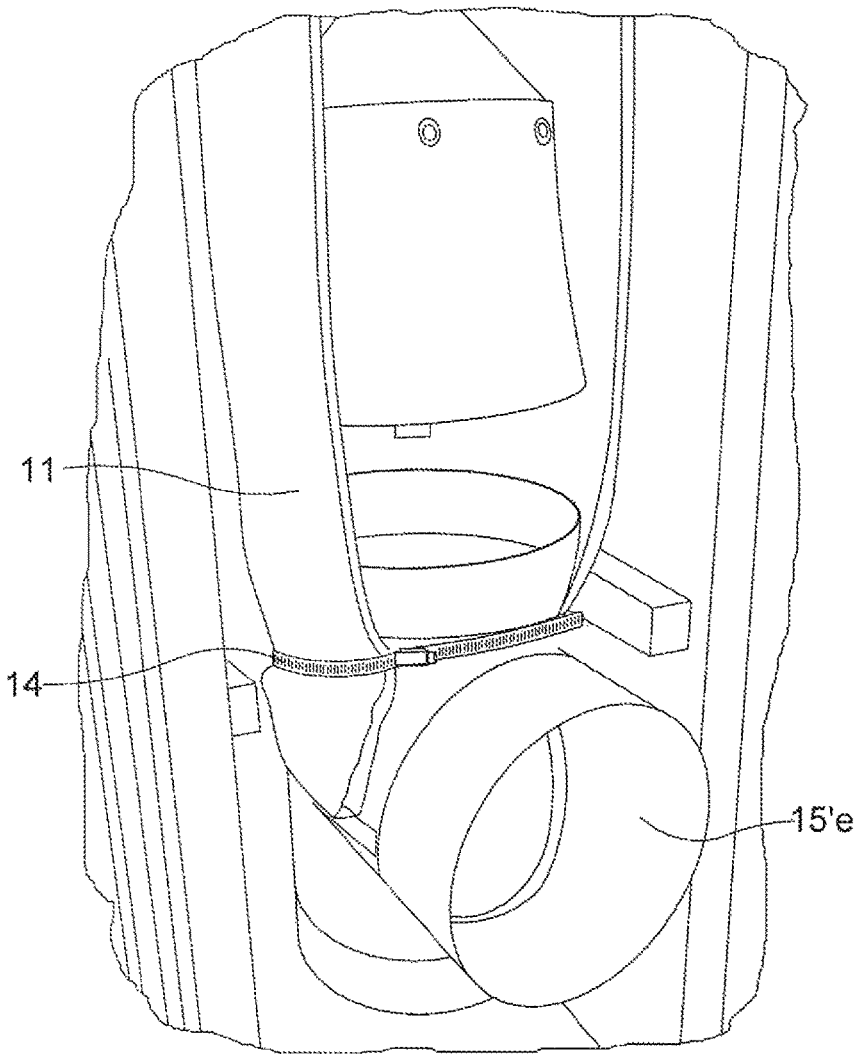
FIG. 10 shows one embodiment of a bottom end adaptor, according to one preferred embodiment of the present invention.
Figure 11:
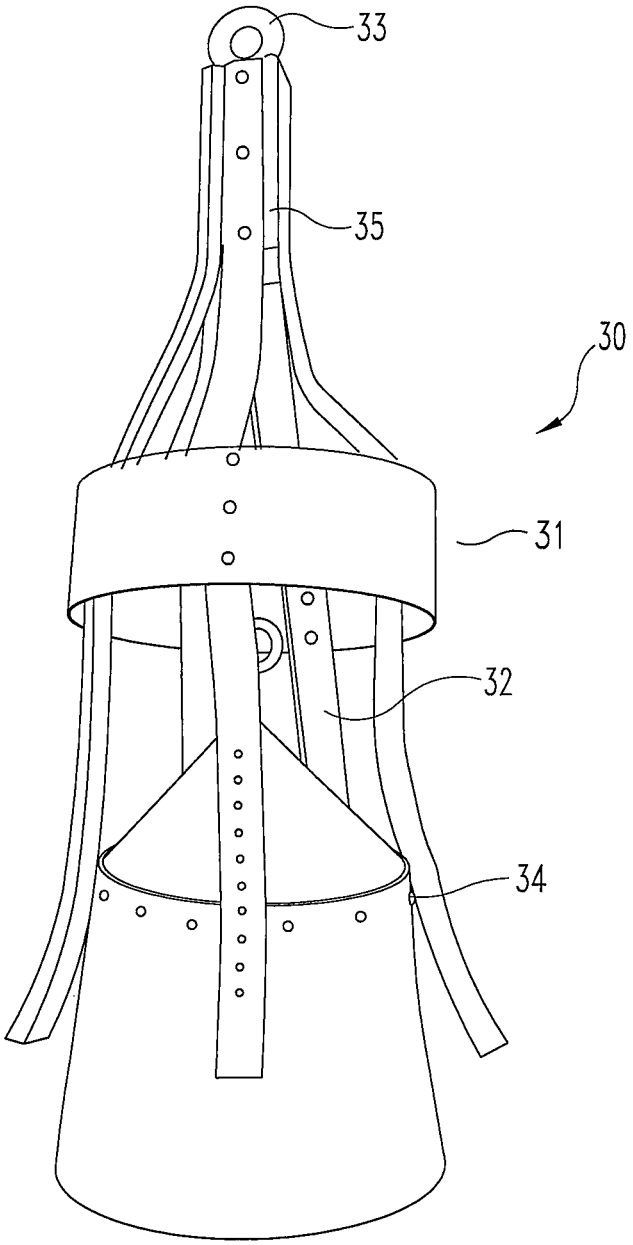
FIG. 11 shows one embodiment of a centering device, according to one preferred embodiment of the present invention.

One embodiment of a centering device is shown in FIG. 7. Centering device 30 may include a ring portion 31 sized to approximate the size of the sleeve. Arms 32 connect ring 31 to applicator 21, with arms 32 preferably being attached by screws or bolts 34 to applicator 21. An eye bolt may be provided at the top of the centering device to allow the device to be hung from a rope, cable, cord or chain.

The flowable refractory cement or ceramic material may be pumped, poured, sprayed or dropped from the top opening onto the applicator to a depth that provides a sufficient head pressure to cause the flowable refractory material to pass over the applicator as it is pulled up the sleeve assembly by the operation of the winch, placing or applying the flowable refractory to a uniform thickness determined by the distance from the side of the applicator to the interior of the sleeve. The flowable refractory material is preferably applied to a thickness in the range of approximately ⅛" to 1", although a thickness greater than 1" may be used in some embodiments.

A visible indicator 35 of flowable refractory material depth may be provided above applicator 21, preferably below eye bolt 33. The visible indicator provides a guide of the depth of flowable refractory cement that has been provided above the applicator, thus providing guidance as to the head pressure provided by the refractory material. When the head pressure is consistent and controlled, a smooth and even application of flowable material may be provided.

After the flowable refractory material is applied, it is allowed to harden on the sleeve. Supplemental air flow (fans) may be used, as may supplemental heat to facilitate drying.

The flowable refractory material may be cured. In some embodiments, relatively low temperature firing may be used to cure the material. In other embodiments, higher temperature curing may be used. Alternatively, UV light or other means may be used to cure the refractory material.

After the refractory material has hardened, it provides a barrier effective to keep flue gasses, moisture, etc. from seeping through the chimney and leaking into the building.

4. Advantages

Many advantages of the present invention are noted above. It should be reiterated however, that one advantage of the present invention is that the lining can easily be removed if desired in the future. Also, the inventive lining does not disfigure when subjected to high temperatures such as chimney fire conditions (e.g., 2100° F.) as in UL1777 or ULC-S635-00. Finally, the inventive liner system is unaffected by combustion by-products.

Perhaps most importantly, the inventive materials and methods provide a chimney lining system that meets the requirements of UL 1777-04 (specifically, UL 1777 third edition, dated Feb. 27, 2004) and ULC-S635. For example, when UL 1777-04 1400° F. and 2100° F. tests are performed, the maximum temperature attained on surfaces of the test structure and on surfaces of the chimney liner assembly at zero clearance to the test structure are not more than 140° F. above ambient (for the 1400° F. test) and 175° F. above ambient (for the 2100° F. test), respectively. In certain embodiments of the present invention, when UL 1777-04 1400° F. and 2100° F. tests are performed, the maximum temperature attained on surfaces of the test structure and on surfaces of the chimney liner assembly at zero clearance to the test structure are not more than 70° F. above ambient (for the 1400° F. test) and 90° F. above ambient (for the 2100° F. test), respectively.

Reference will now be made to specific examples using the materials and methods described above. It is to be understood that the examples are provided to more completely describe preferred embodiments, and that no limitation to the scope of the invention is intended thereby.

Example 1

A flowable refractory material is prepared and applied to a flexible sleeve, where it is allowed to cure to a hard coating that does not disfigure when subjected to high temperatures such as chimney fire conditions (e.g., 2100° F.) as in UL1777-04 or ULC-S635-00.

The sleeve is made from a ceramic paper that is a blend of high purity ceramic fibers comprising about 47% $Al_2O_3$ and about 53% $SiO_2$, optionally with trace amounts of organic binders, and having a melting point of about 3200° F., a maximum temperature rating of 2300° F., and a continuous use limit of 2150° F. In this case the ceramic paper was a ¼" layer of the ceramic paper sold under the trade name Kaowool® Flex-Wrap, although a thicker or thinner (e.g., ⅛") material may be used.

To make the sleeve the Kaowool® Flex-Wrap paper is wrapped around a mandrel sized to make a sleeve having a diameter of about 1" greater than the desired ending flue size. The paper is wrapped around the mandrel with approximately a 2" overlap, and is glued with a high temperature silicone-rubber caulk to make the desired tube shape.

The ceramic paper is covered with a foil layer, which in this case was a triple ply laminate having a fiberglass scrim adhered with a fire retardant, thermo-setting adhesive to an aluminized polyester face and an aluminum foil backing, sold under the trade name "Alaflex" by Alpha Associates. A stainless steel mesh was provided over the sleeve material to reinforce and protect the sleeve during placement in a chimney. The sleeve had a diameter of about 9" in this example, to produce an 8" lined flue.

The flowable refractory material used in this example is a blend of inorganic minerals and binders sold under the tradename "Eldfast" by the Fa: J. Kikson Company, Vallentuna, Sweden. Eldfast is a ceramic material that does not contain cement or lime, and is a blend of inorganic materials and inert aggregates together with a high temperature resin bonding agent in a powdered form. The composition comprises 60-80% $Al_2O_3$ and 40-20% $SiO_2$. In this example a 25 kg bag of Eldfast is mixed with about 5 L of water and mixed to produce a slurry that can be applied by a "pull-up" applicator as described above. Several mixtures of the slurry are used to line the sleeve, with the exact amount depending on the sleeve length.

After the sleeve is inserted in the chimney it was secured at both ends. A centering device is attached to an applicator, and the applicator is positioned inside the bottom of the sleeve. One end of a cable is attached to the top of the applicator, and the other end of the cable is attached to a winch at the top of the chimney.

The first measure of flowable refractory material, approximately 60#, is poured down the sleeve from above so that is fills the space immediately around and above the applicator. The centering device helps keep the applicator centered so that there is approximately ½" space between the applicator and the sleeve all the way around the circumference of the applicator. The flowable refractory material seeps around the applicator and coats the sleeve.

As the flowable refractory material seeps around the applicator and coats the sleeve, the winch is used to pull the applicator toward the top of the sleeve. Additional flowable refractory material (slurry) is poured down from above to maintain the head pressure appropriate to push the material around the applicator to coat the sleeve. A visible indicator on the cable or the centering device may be used to indicate when a sufficient amount of material (in this case about 50 pounds) is provided to the applicator.

The process described above continues as the applicator is pulled to the top of the sleeve. When the coating process is complete, the material is allowed to dry and cure. The lined sleeve provides a barrier effective to keep flue gasses, moisture, etc. from seeping through the chimney and leaking into the building.

After the material has dried and cured, it may be tested to confirm that the chimney lining system meets the requirements of UL 1777-04 (specifically, UL 1777 third edition, dated Feb. 27, 2004) and ULC S635-00 (specifically, second edition dated June 2000). In this case, when UL 1777-04 1400° F. and 2100° F. tests were performed, the maximum temperature attained on surfaces of the test structure and on surfaces of the chimney liner assembly at zero clearance to the test structure was not more than 140° F. above ambient for the 1400° F. test, nor more than 175° F. above ambient for the 2100° F. test.

5. Alternative Embodiment

In an alternative embodiment there is provided a method of relining a chimney, comprising: coating the inside surface of a chimney flue with a first layer of a flowable refractory material, thus providing a wet and sticky surface on the inside of said chimney flue; providing an insulating sleeve on the wet and sticky refractory surface in a manner such that the insulating sleeve adheres to the wet and sticky refractory surface; subsequently coating the inner surface of said sleeve with a second layer of flowable refractory material effective for hardening on the sleeve to provide a refractory surface on the inner surface of the sleeve; and allowing both layers of flowable refractory material to harden, thus providing a hardened relining comprising a first refractory layer, an insulating layer, and a second refractory layer on the inner surface of the sleeve.

The insulating sleeve is preferably a multi-layer sleeve comprising a first, outer layer, an inner layer, and a second outer layer. The two outer layers are preferably made of a metal wire material, such as a wire fabric and/or a high temperature wire screen material or a high temperature knitted mesh. The wire screen or mesh material preferably has a screen and/or mesh size/density that is sized to allow the screen or mesh to embed in the flowable refractory material so that the refractory material grips and holds the metal mesh (and thus the insulating layer). If a knitted mesh is used, a density of about 60 has been preferred in testing to date.

The high temperature wire fabric material may comprise stainless steel, or it may be a high-temperature alloy such as an austenitic nickel-chromium-based alloy such as Inconel® and/or Incoloy® alloys. The preferred wire mesh is capable of being used in environments of 1000° F. or more, and preferably environments of 2100° F. or more.

The middle insulating layer is preferably made of an insulating ceramic paper or ceramic wool material, such as ⅜" ceramic fiber paper. The insulating layer may be a ceramic fiber paper that is manufactured by forming alumino-silicate fibers in a nonwoven matrix. Fiberfrax ceramic fiber papers such as Fiberfrax 970, Fiberfrax 550, etc. may be used. Alternatively, the insulating layer may be a high temperature insulation wool (HTIW), such as "amorphous" HTIW (e.g., alumino silicate wool or alkaline earth silicate wool) or polycrystalline wool. The middle insulating layer preferably provides insulation sufficient to allow the insulating sleeve to pass the U.L 1777 standard when used to line a chimney flue.

The preferred insulating material is capable of being used in environments of 1500° F. or more, and preferably environments of 2100° F. or more. The preferred insulating material provides low heatflow (low thermal conductivity) when a layer of ½" or less is used in a high temperature (in excess of 1500° F., and preferably in excess of 2100° F.) environments.

Figure 12:
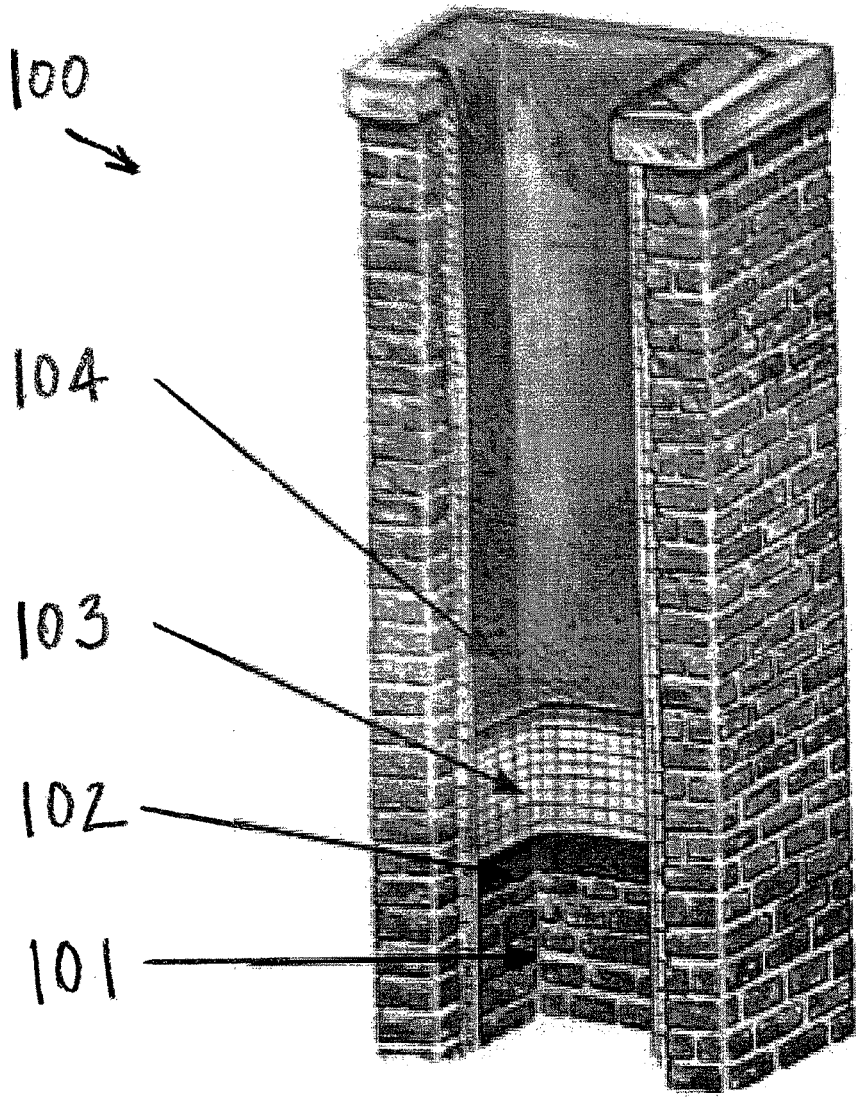
FIG. 12 shows an alternative embodiment of the chimney relining method of the present invention.

Referring now to the Figures, FIG. 12 shows one embodiment of the chimney relining method of the present invention. Relined chimney 100 includes inner flue wall 101. Applied to that is a first, refractory layer 102, which comprises a flowable refractory material that provides a "wet" and "sticky" surface over flue wall 101. An insulating layer 103 is then applied over first refractory layer 102 while the first refractory layer is still wet and sticky so that the insulating layer adheres to the first refractory layer. A second, flowable refractory layer 104 is then applied over the insulating layer, and the two flowable refractory layers are allowed to dry. At some places, and particularly at the upper and/or lower edges, the two flowable refractory layers may intermingle to provide a single refractory layer. After drying/curing, the relined chimney comprises a flue that has been relined with a multi-layer composition comprising a first refractory layer, an inner insulating layer, and a second refractory layer.

Figure 13:
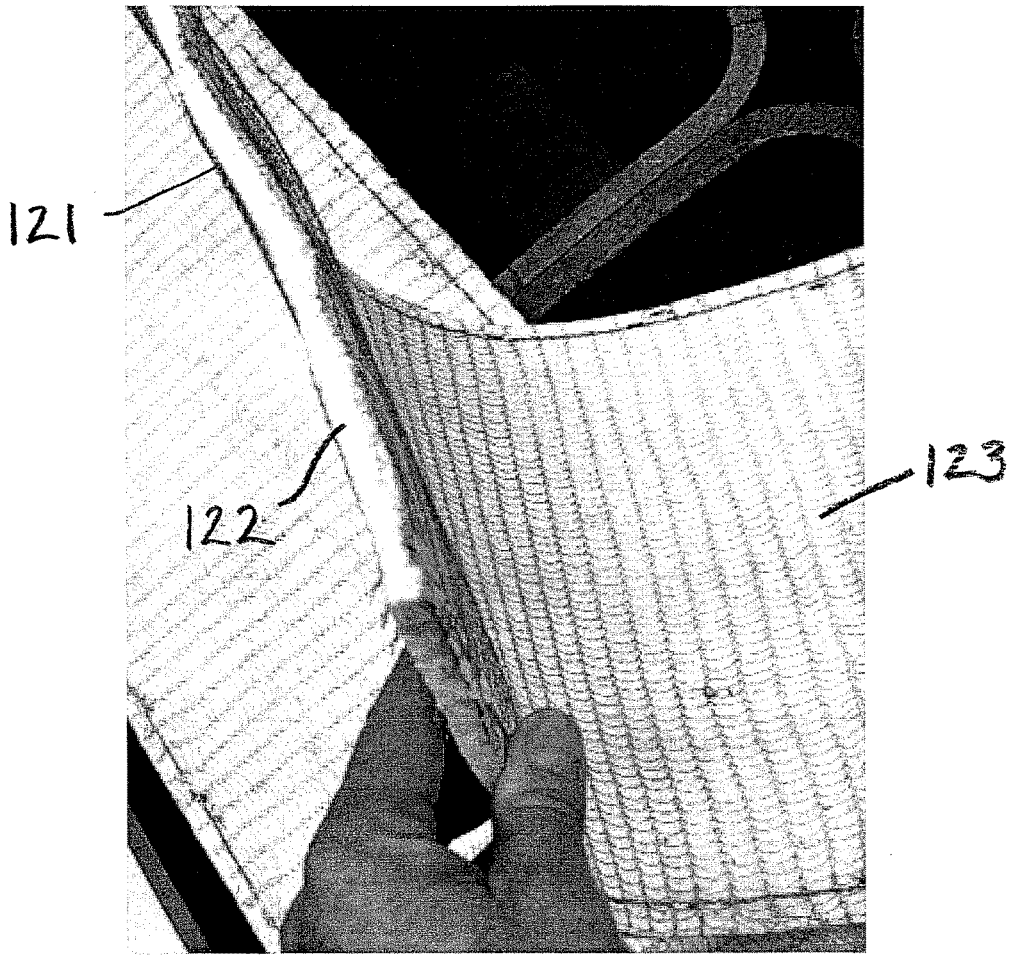
FIG. 13 shows an insulating sleeve useful for the alternative embodiment of the chimney relining method shown in FIG. 12.

FIG. 13 shows one embodiment of an insulating layer that may be used with the present invention. Insulating layer 103 includes a first outer metal mesh layer 121, a middle insulation layer 122, and a second outer metal mesh layer 123. The illustrated outer metal mesh layers are each a 60 density 304 stainless steel alloy, and the illustrated insulation layer is a ⅜" $Al_2O_3/SiO_2$ ceramic fiber paper.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of relining a chimney flue, comprising:

a) coating an innermost surface of a chimney flue with a first layer of a flowable refractory material, thus providing a wet and sticky surface on the innermost surface of said chimney flue;

b) providing an insulating sleeve on the wet and sticky refractory surface in a manner such that the insulating sleeve adheres to the wet and sticky refractory surface;

c) subsequently coating an inner surface of said sleeve with a second layer of flowable refractory material effective for hardening on the sleeve to provide a refractory surface on the inner surface of the sleeve; and d) allowing both layers of flowable refractory material to harden, thus providing a hardened relining comprising a first refractory layer, an insulating layer, and a second refractory layer, on the innermost surface of the flue.

2. The method of claim 1 wherein said insulating sleeve comprises a first outer layer comprising a metal wire fabric material, an inner layer comprising a ceramic wool having a maximum temperature rating of at least 2300° F., and a second outer layer comprising a metal wire fabric material.

3. The method of claim 1 wherein said flowable refractory material comprises a blend of inorganic materials and inert aggregates together with a high temperature resin bonding agent.

4. The method of claim 3 wherein said flowable refractory material comprises 50-80% $Al_2O_3$ and 10-40% $SiO_2$.

5. The method of claim 1 wherein said refractory material is a material capable of withstanding temperatures of at least 2100° F.

* * * * *